US010233071B2

(12) United States Patent
Whaley

(10) Patent No.: US 10,233,071 B2
(45) Date of Patent: Mar. 19, 2019

(54) FLUID DISPENSER

(71) Applicant: Kevin Whaley, Santee, CA (US)

(72) Inventor: Kevin Whaley, Santee, CA (US)

( * ) Notice: Subject to any disclaimer, the term of this patent is extended or adjusted under 35 U.S.C. 154(b) by 0 days.

(21) Appl. No.: 16/028,990

(22) Filed: Jul. 6, 2018

(65) Prior Publication Data

US 2019/0010045 A1 Jan. 10, 2019

Related U.S. Application Data

(60) Provisional application No. 62/530,009, filed on Jul. 7, 2017.

(51) Int. Cl.

| | |
|---|---|
| ***B67D 3/00*** | (2006.01) |
| ***B05C 7/08*** | (2006.01) |
| ***B67D 3/02*** | (2006.01) |

(52) U.S. Cl.

CPC ..... *B67D 3/0058* (2013.01); *B05C 7/08* (2013.01); *B67D 3/02* (2013.01)

(58) Field of Classification Search

CPC ..... B67D 3/0058; B67D 3/02; B05C 7/08
USPC ..... 222/145.1, 142.6, 142.7, 144.5, 145.4, 222/213, 484–487; 224/148.2; 68/17 R, 68/207, 12.02

See application file for complete search history.

(56) References Cited

U.S. PATENT DOCUMENTS 1,954,261 A * 4/1934 Pierce ..... D06F 33/06 137/240
2,783,919 A 3/1957 Ansell
3,022,656 A 2/1962 Bergeson et al.
3,122,272 A 2/1964 Marsh
3,952,918 A 4/1976 Poitras et al.
4,182,496 A 1/1980 Burke
4,331,262 A 5/1982 Snyder et al.
4,381,006 A 4/1983 Genese
5,199,604 A * 4/1993 Palmer ..... A61C 1/0084 222/136
5,230,443 A * 7/1993 Du ..... B67D 1/102 222/134
5,332,157 A 7/1994 Proctor
5,435,157 A * 7/1995 Laughlin ..... D06F 39/022 137/889
5,743,431 A 4/1998 Brattesani
5,881,922 A * 3/1999 Hawkins ..... B67D 1/08 222/144.5
6,045,759 A 4/2000 Ford et al.
6,158,486 A 12/2000 Olson et al.
6,192,945 B1 2/2001 Ford et al.
6,413,238 B1 7/2002 Maget
(Continued)

*Primary Examiner* — Lien M Ngo
(74) *Attorney, Agent, or Firm* — Mark Wisnosky

(57) ABSTRACT

A novel fluid dispenser system is described. The system is comprised of a plurality of connectors that each connect to one a plurality of fluid supply containers and, once connected, hold a valve on the supply container in an opened position. The connectors are connected, using flexible tubing, to a valve manifold that selectively dispenses fluid from each of the supply containers. The system provides a means of selectively and safely delivering fluid from large and ungainly supply containers without the need for lifting or otherwise manipulating the supply container itself. The system is especially useful in delivering laundry detergent and other additives from supply containers to a washing machine in a home use application.

6 Claims, 10 Drawing Sheets

(56) References Cited

U.S. PATENT DOCUMENTS

| | | | | |
|---|---|---|---|---|
| 7,398,787 | B2 * | 7/2008 | Hsu | D06F 39/022 134/113 |
| 7,658,088 | B2 * | 2/2010 | Walker | D06F 39/02 68/17 R |
| 9,149,109 | B2 * | 10/2015 | Slaton | A45F 3/16 |
| 2005/0155983 | A1 * | 7/2005 | Robinson | B67D 3/0029 222/143 |
| 2006/0117811 | A1 | 6/2006 | Kinnetz | |
| 2007/0075093 | A1 * | 4/2007 | Thomasmeyer | B67D 3/00 222/159 |
| 2007/0090135 | A1 * | 4/2007 | Benham | A45F 3/20 224/148.2 |
| 2011/0162740 | A1 * | 7/2011 | Tsai | F15D 1/02 137/605 |

* cited by examiner

FLUID DISPENSER

CROSS-REFERENCE TO RELATED APPLICATIONS

This application claims priority to U.S. Provisional Application 62/530,009, titled Fluid Dispenser, filed on 7 Jul. 2017, by the same inventor and currently pending.

STATEMENT REGARDING FEDERALLY SPONSORED RESEARCH OR DEVELOPMENT

Not Applicable.

BACKGROUND OF THE INVENTION

Technical Field

The invention relates to a fluid dispenser that includes a manifold and valve connected to a supply reservoir.

Related Background Art

Dispensing fluids from a supply container is a common household, pharmacy and laboratory exercise. In many cases there is a large supply container and smaller aliquots need to be taken from this container. Recently, for home use laundry detergent, softener and bleach containers have been designed to sit on a shelf and include a dispensing nozzle. The dispensing nozzle includes a push button. Dispensing requires dispensing into a measuring container and the emptying the measuring container into the tub on a washer or into a receptacle built into the washer for receiving these washing components. Frequently, in laundry room designs, the shelf that holds the detergent softener and bleach containers are located directly above the washing machine and necessarily, to allow clearance for the lid of the washing machine, located at about eye level. There is a risk of splashing when dispensing causing potential irritation or injury if splashed into the face or eyes of the user. Also frequently the containers are too heavy to lower below eye level for each dispensing. Similarly, in the lab, pharmacy or industrial setting supply solutions are stored on shelving or in cabinets and must be carried to the location of use for dispensing. Too often, dispensing requires pouring hazardous material from a gallon or larger container into a small measuring device with risk of spills and splashing.

There is a need for a system that aids in the safe dispensing of fluids from supply containers. There is a need for a system that can connect to modern packaging designs for laundry products.

BRIEF SUMMARY OF THE INVENTION

The present invention discloses a dispensing system designed to connect to a supply container having a dispensing spigot and valve. The system is comprised of a connector that snaps onto a dispensing nozzle and valve and holds the valve in an open position. The connector includes ports to which tubing is attached. The tubing is routed from the connector to the point of use where a hand actuated valve is used to dispense the fluid from the supply container. The fluid may be dispensed either directly into an apparatus for use, such as a washing machine, or may be dispensed into a measuring container. In one embodiment, the hand actuated valve includes a plurality of ports such that tubing from a plurality of supply containers may be connected to a single hand actuated valve for dispensing a plurality of different solutions. In one embodiment the system is comprised of two snap on connectors that are fitted to a laundry detergent and a laundry softener containers and tubing from each of the connectors is routed to a single hand actuated valve that may then selectively dispense either laundry detergent or softener for use. In another embodiment the system further includes a retractable line attached to the hand actuated valve to hold the valve in an elevated position to avoid leakage and in a convenient location for storage between uses.

The specific examples are not intended to limit the inventive concept to the example application. Other aspects and advantages of the invention will be apparent from the accompanying drawings and detailed description.

DETAILED DESCRIPTION OF THE INVENTION

Figure 1:
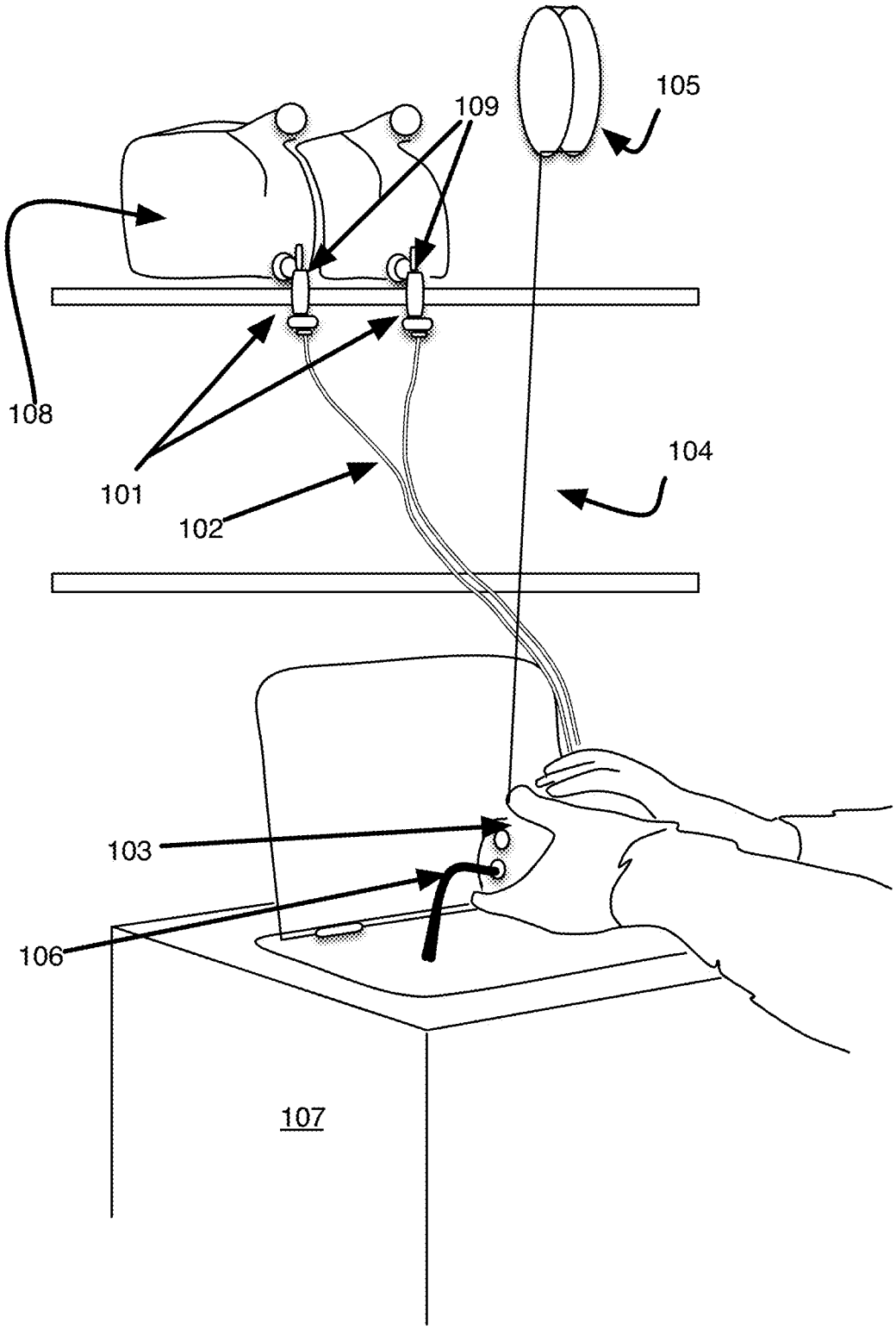
FIG. 1 shows an overview image of the invented system as it appears in one intended use.
Figure 2:
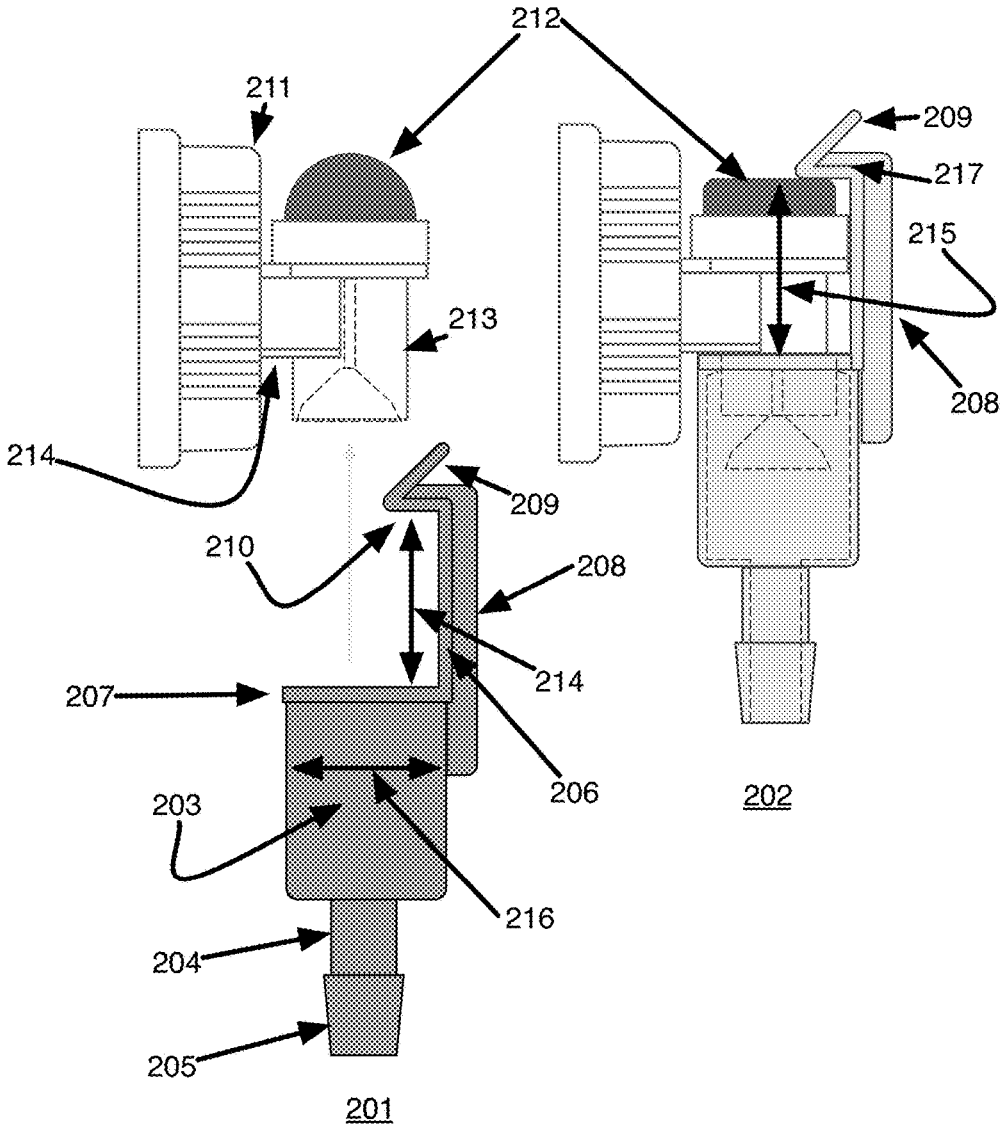
FIG. 2 shows a first embodiment of the snap on connector.
Figure 3:
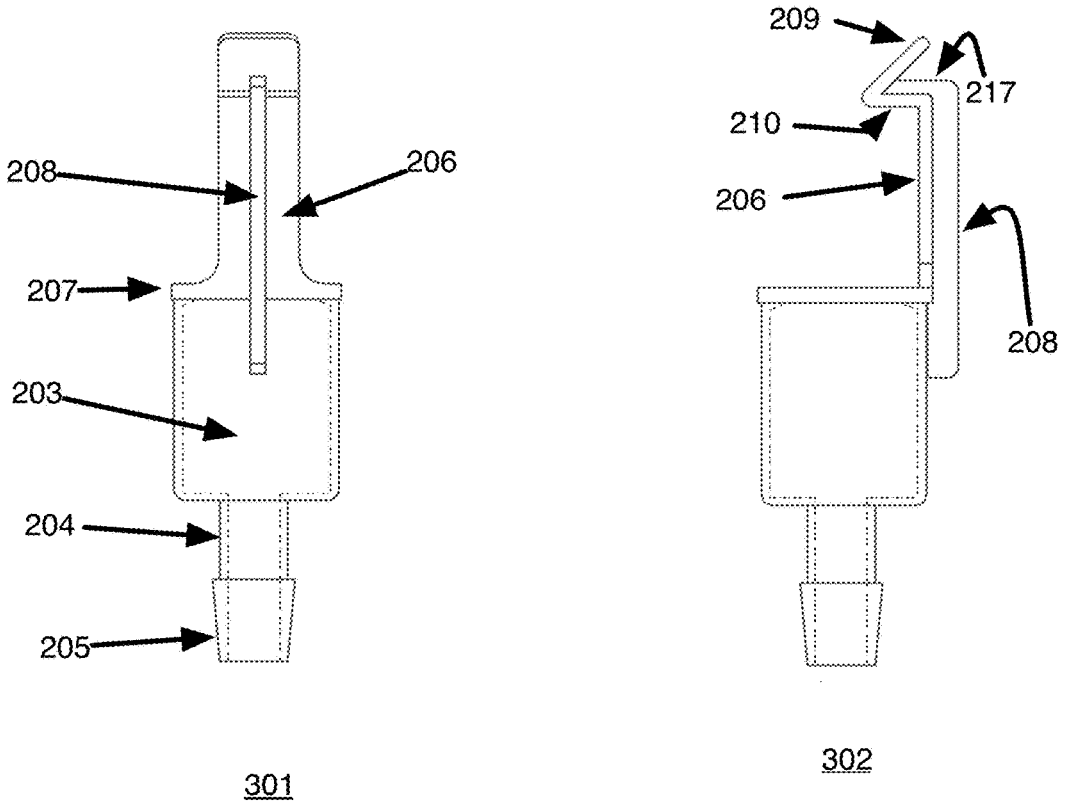
FIG. 3 shows additional views of the connector of FIG. 2.
Figure 4:
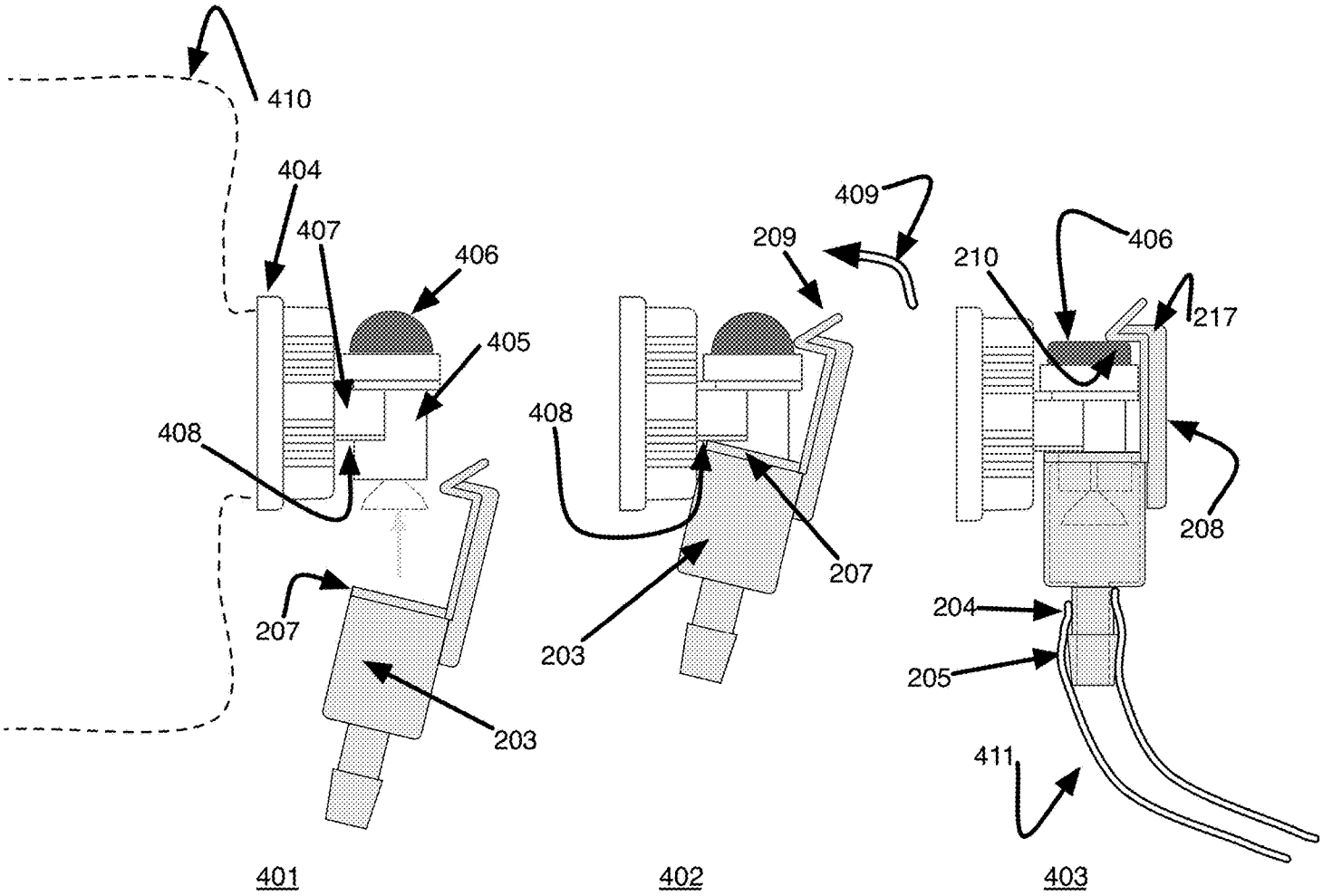
FIG. 4 shows a series of images showing installation of the snap on connector onto a supply container.

FIG. 1 is a view of the invented system as it would be used in a home laundry setting. The system can be similarly used in a laboratory, pharmacy and industrial settings. The system is comprised of a plurality of connectors 101 that fit onto the dispensing spouts 109 of supply containers 108. In a preferred embodiment the connectors are as described in FIGS. 2-6. In another embodiment the connectors are fit to the supply containers by any means known in the art, such as a hose bib, a barbed fitting, and any manner of spigot as are known in the art. There may be from one to many supply containers and connectors. The connectors 101 are connected via tubing 102 to a handheld valve manifold 103 that includes an actuator to allow selection and dispensing from a selected supply container 108. The fluid contained in the supply containers may be dispensed from a common exit port 106. In another embodiment there are a plurality of exit ports (two are shown in the FIG. 1) so that the solutions are dispensed from individual dispensing ports to avoid cross contamination of the solutions in the supply containers 108. In a preferred embodiment the valve manifold 103 is connected by a retractable line 104 to a spring actuated retraction reel 105 such that when not in use the line 104 is retracted and the valve manifold is held in a position near the retraction reel 105 for storage. In a preferred embodiment the retraction reel is held at a level above the supply containers 108 to avoid leakage of fluid from the supply containers between use. FIGS. 2-4 show details of a first embodiment of the snap on connector and its method of use.

Referring first to FIG. 2, the snap on connector 201 is comprised of a main body 203. In the preferred embodiment the main body is cylindrical. The top of the cylinder includes a rim 207 that, in use, is held against the bottom surface 214 of the dispensing spigot 211 that is attached to the supply container (not shown). The main cylindrical body 203 of the connector has a diameter 216 selected to fit snugly over the exit spout 213 of the spigot on the supply container. The rim and the cylindrical body 203 thereby form a seal to the spout 213 of the supply container that prevents fluid from exiting over the top of the rim 207. The only fluid path is through the connector and out the exit port 204. Attached to the bottom surface of the cylinder 203 is an exit port 204. Tubing 102 is attached to the exit port 204 for attachment to the handheld valve manifold 103. The tubing and the valve manifold are shown in FIG. 1. A tapered enlargement 205 is used to secure the tubing to the exit port 204. The connector further includes a clip 206, 208, 209, 210 extending upward from the main cylindrical body rim 207. The clip is comprised of an essentially flat vertical tab 206 (seen in profile in this FIG. 2) that has a dimension 214 in the vertical direction that is selected to match the height 215 of the valve 211 on the supply bottle when the release button 212 on the valve is in a compressed or held in an open position as shown in the view 202. The clip further includes a reinforcing rib 208 that is a flat mostly rectangular piece that is attached perpendicular to the plane of the main body 206 of the tab. The reinforcing rib extends vertically below the rim 207 and attaches to the main cylindrical body 203 of the connector. The upper end 217 of the clip is bent at a right angle such that it extends over the top of the release button 212 when the clip is attached to the spout of the supply bottle as shown in the view 202. The top of the clip is further bent at an acute angle opposite to the right angle bend 217 to form a handle 209. Pulling on the handle in a direction away from the spout cause the release of the connector from the supply bottle spout. Note that the geometry of the connector and the clip results in automatic depression of the release button 212 and opening of the valve on the spigot, only when the connector is in a position over the spout 213. The clip releases the button and therefore closes of the valve on the spigot, when the connector is tilted away from the spout for removal. FIG. 3 shows a front view 301 and a side view 302 of the connector. The parts of the connector are numbered consistently with those of FIG. 2. The front view 301 allows a better view of the essentially flat portion 206 of the tab with the reinforcing rib 208. The reinforcing rib 208 is also an essentially flat piece as seen in the profile view 302 and extends vertically upward to the top of the tab 217 and downward to below the rim 207 of the main cylindrical body 203 of the connector.

FIG. 4 shows a sequence of views 410, 402, 403 that depict the connector being attached to a spigot of a supply container. The connector is brought up to the spigot 404-408 that is connected to the supply container 410 and the rim of the connector is mated against the bottom surface 408 on the spigot of the supply container and the main cylindrical body of the connector 203 is fitted over the exit spout 405 all as shown in the second view 402. The connector is then rotated in the direction 409 thereby causing the upper end 217 of the clip on the connector to extend over and depress the push button actuator 406 on the supply container. The depressing causes the valve on the supply container to open and allows fluid to flow through the spout 405 and through the connector exiting at the exit port 204. Tubing is fit over the flared connector 205 and the fluid from the supply container 410 flows through the tubing 411 to the manifold valve as shown in FIG. 1.

Figure 5:
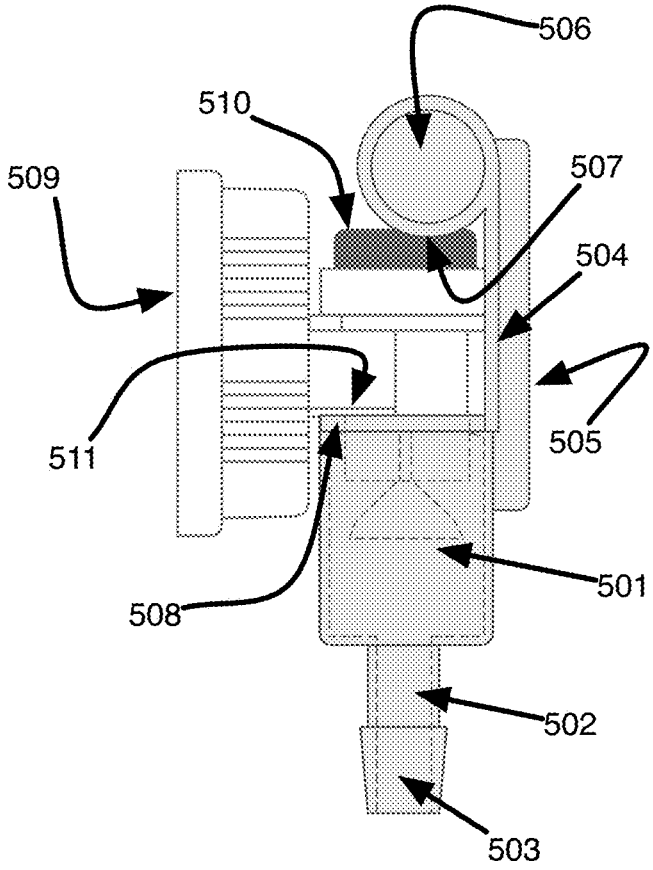
FIG. 5 shows a second embodiment of the snap on connector.

FIG. 5 shows a second embodiment of the clip. The FIG. 5 shows this embodiment as it would be attached to the valve and nozzle 509 of a supply container. The main difference in this embodiment form that described in FIGS. 2-4 is the configuration of the top of the tab on the connector. The connector is comprised of a main cylindrical body 501 as before the body sized and shaped to fit over the nozzle of the supply container supply valve 509. The cylindrical body, also as before, includes a rim 508 that fits against the bottom surface of the supply valve 511. The connector further includes an exit port 502 and a flared enlargement 503 in the exit port for securing flexible tubing that then connects at the opposite end to the valve manifold for dispensing of the liquids from the supply container. The connector further includes a vertical clip 504 with a reinforcing rib 505. In contrast to the previous embodiment the top of the clip includes a cylindrical extension 506 such that when the connector is fit over the supply container valve and spout, the bottom of the cylindrical projection 507 presses against the flexible valve actuator 510 thereby depressing the actuator and opening the valve to the supply container. An advantage of this configuration over that of FIGS. 2-4 is that in some cases the supply valve 509 requires that the flexible release button be pressed further downward beyond the horizontal.

Figure 6:
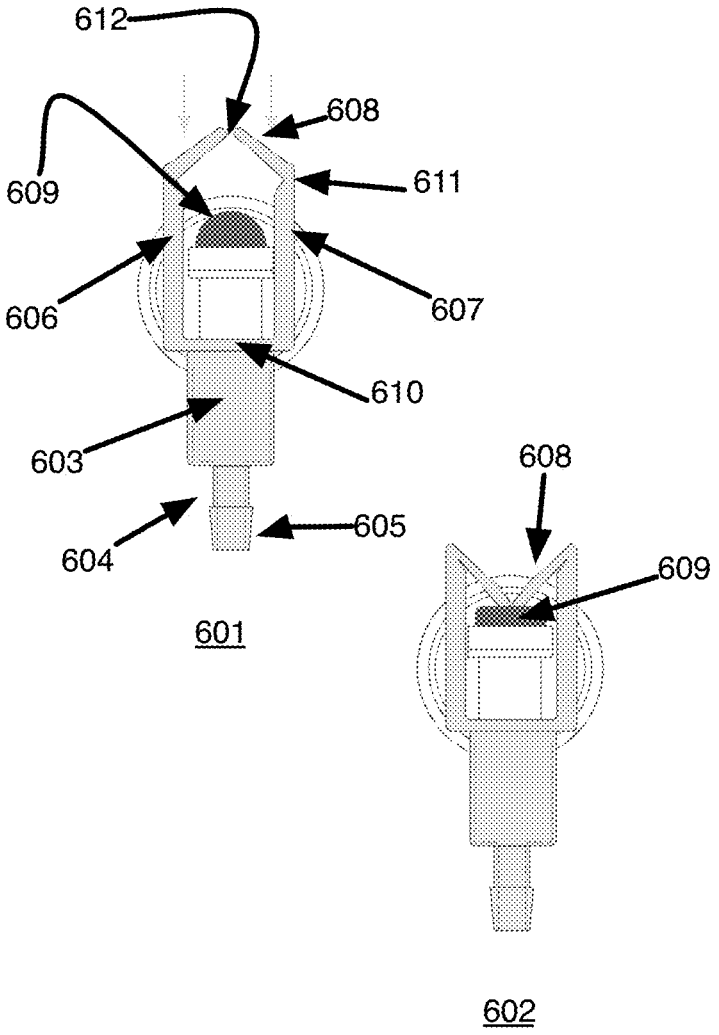
FIG. 6 shows a third embodiment of the snap on connector.

FIG. 6 shows a third embodiment of the connector. As for the two previous embodiments the main components of the connector include a cylindrical body 603, an exit port 604, a flare on the exit port 605 to secure flexible tubing (not shown) to the connector. The vertical clip in this instance includes a pair of vertical members 606 extending from the upper rim 610 of the main cylindrical body. The top of the vertical members includes a pair of fingers 6087 that are joined to the vertical members at their bases 611 and are joined together at the distal end from the bases 612. Both of the joints are flexible and the fingers 608 have a length slightly longer than the width between the vertical members such that pressing downward at the point 612 causes the fingers to snap from the position in the first view 601 to the position in the second view 602. In the first view 601 the flexible release button 609 is in a closed position and in the second view the release button 609 is depressed and therefore held in an open position.

Figure 7A:
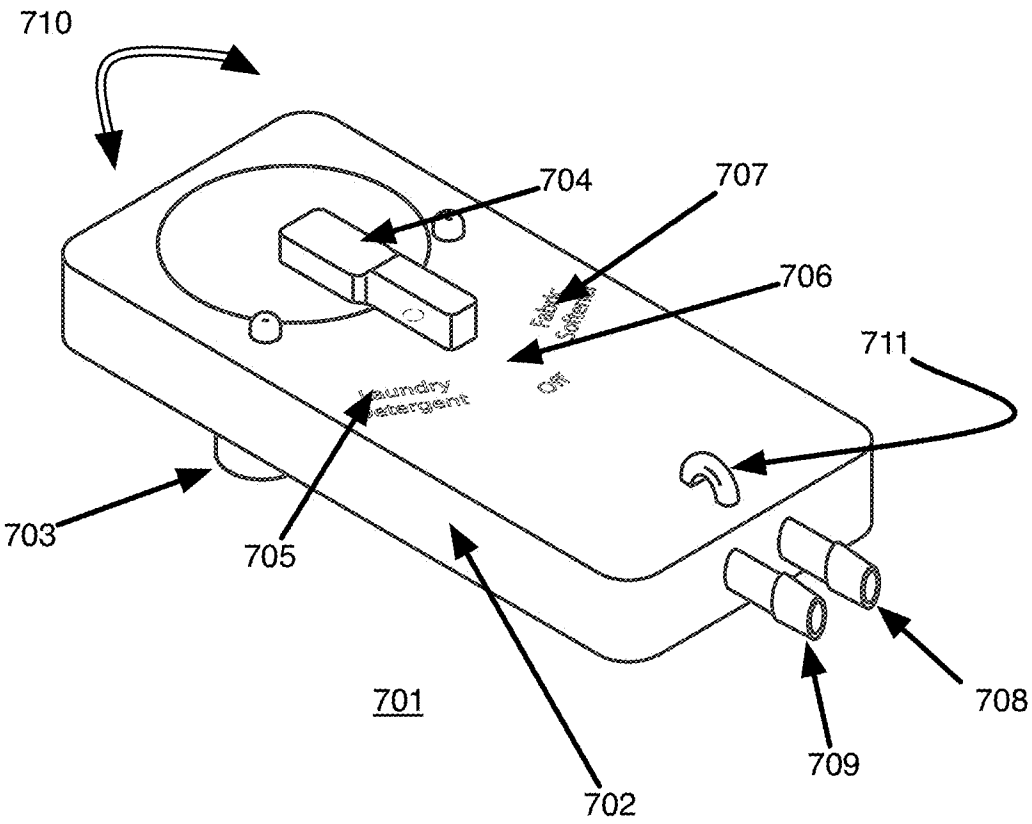
FIG. 7A shows an embodiment of the hand held valve.
Figure 7B:
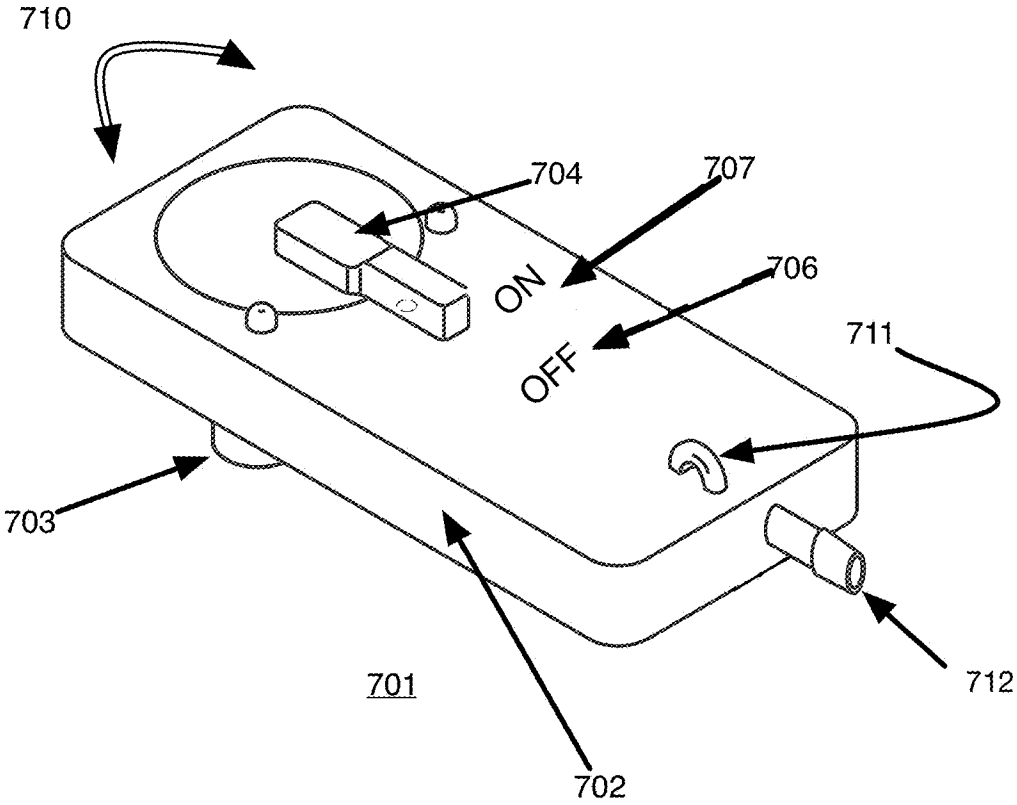
FIG. 7B shows a second embodiment of the hand held valve with a single inlet connection.

FIG. 7A shows a view of the manifold valve component of the invented system. The manifold valve 701 is comprised of a housing 702 and a plurality (here two are shown) of input ports 708, 709 and an exit port 703. A multiport valve (not shown) as is known in the art is included inside the housing and connected to the ports 703, 708, 709. The multiport valve is controlled by a lever 704 that may be rotated 710 to a plurality of positions 705, 706, 707. In the example shown there are three such positions since the example uses two input ports 708, 709. The location of the lever's positions determines the position of the multiport valve and the connections between the ports 703, 708, 709. In a first position 705, a first inlet port 709 is connected to the outlet port 703. In a second position 707, a second inlet port 708 is connected to the outlet port 703. In a third position 706, neither inlet port is connected to the outlet port and flow from through all three ports is stopped. The plurality of ports 708, 709 are connected using flexible tubing to the connectors attached to a plurality of supply containers as shown in FIG. 1. In another embodiment the multiport valve connects the plurality of inlet ports 708, 709 sequentially to a plurality of outlet ports (shown in FIG. 1) such that each inlet port can be connected to a single one of the plurality of outlet ports, thereby avoiding cross-contamination of the fluids supplied to each inlet port. The valve manifold further includes a connector 711 to which, in practice, is attached a retractable line such that the valve manifold may be held in a secure position when not in use as described in FIG. 1. In another embodiment shown in FIG. 7B, there is a single entry point 712 that is connected through a multiport valve to a single exit 703. The actuator 704 is turned 710 from an OFF position 706 to an ON position 707 to connect the entry port 712 to the exit 703.

Figure 8:
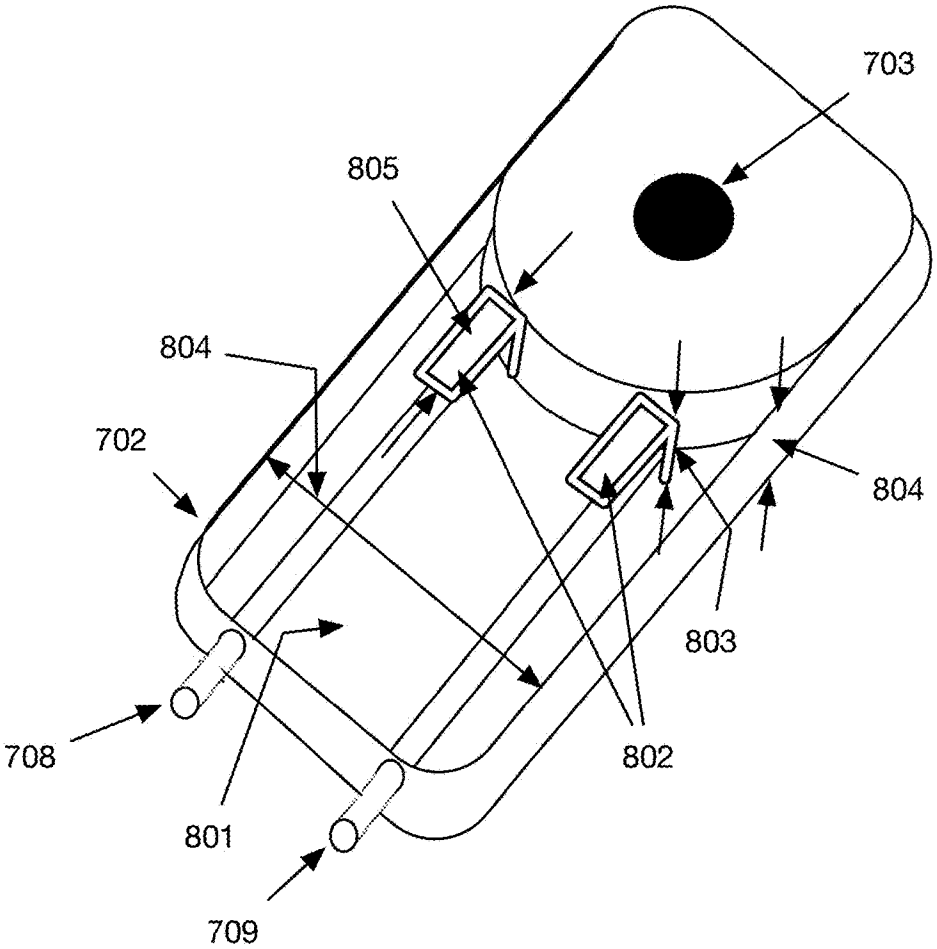
FIG. 8 shows an embodiment of the hand held valve further including a cavity in the housing and a hanging hook.
Figure 9:
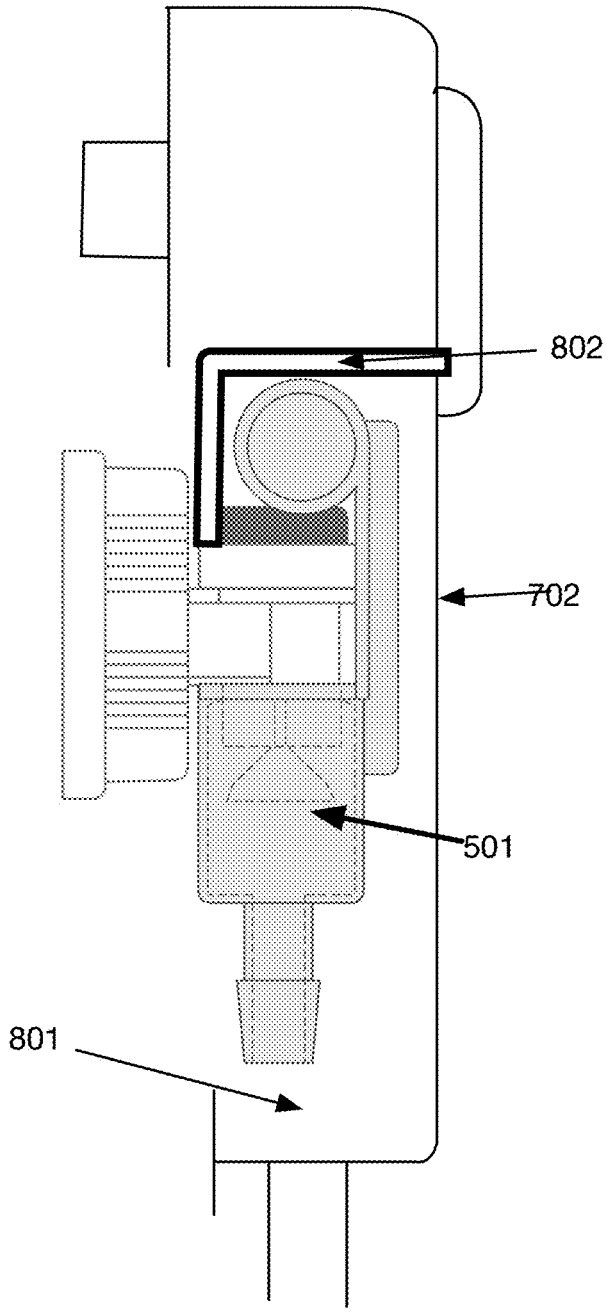
FIG. 9 shows the embodiment of FIG. 8 with the hook attached to a dispensing spigot.

In another embodiment shown in FIG. 8, the back side of the dispenser housing 702 is seen to further include a cavity 801 and at least one, here two are shown, L shaped hanging clips 802 attached to and protruding from the back of the housing 702 a distance 803 from the housing and oriented to form a hook such that the dispenser housing may be removably attached to an object for storage. The hook 802 has a first dimension 803 extending away from the housing and an arm with length 805 extended essentially parallel to the plane of the bottom surface (not labeled, but also pointed to by 801) of the cavity 801. The cavity 801 has a depth 804. Additional elements labeled in FIG. 8 are as already discussed. FIG. 9 shows a side cross-sectional view of the housing of FIG. 8 where the hook 802 and cavity 801 of the dispenser housing 702 fits over a spigot 501 for storage.

SUMMARY

A novel fluid dispenser system is described. The system is comprised of a plurality of connectors that each connect to one a plurality of fluid supply containers and, once connected, hold a valve on the supply container in an opened position. The connectors are connected, using flexible tubing, to a valve manifold that selectively dispenses fluid from each of the supply containers. The system provides a means of selectively and safely delivering fluid from large and ungainly supply containers without the need for lifting or otherwise manipulating the supply container itself. The system is especially useful in delivering laundry detergent and other additives from supply containers to a washing machine in a home use application.

I claim:

1. A fluid dispenser comprising:

a. a plurality of connectors, each of the connectors to connect to one of a plurality of fluid containers, each of the plurality of fluid containers including a spigot that includes an outlet tube, the outlet tube comprising a cylinder with a longitudinal axis, and a valve, the valve opened by pushing on a push button in a direction parallel to the longitudinal axis and in the direction of the outlet tube, and, b. each of the plurality of connectors comprising:

i. a hollow cylindrical body, having a first end and a second end, ii. the first end sized to fit over the outlet tube of the spigot of the fluid container, and, iii. the second end having an exit port that includes a barb for connection to flexible tubing, and, iv. a clip extending vertically from a rim of the first end, the clip terminating with a right angle bend that simultaneously: secures a tab to the spigot, and, depresses the push button thereby opening the valve on the spigot, and, c. a valve manifold comprising:

i. a plurality of inlet ports, each of the plurality of inlet ports connected via the flexible tubing to the exit port of one of the plurality of connectors, ii. a multiport valve that includes an actuator having a plurality of positions that connects sequentially each of the plurality of inlet ports to an exit port based upon the position of the actuator and thereby dispenses sequentially fluid from one of the plurality of fluid containers through the exit port.

2. A connector for connecting to a spigot of a fluid dispenser, the spigot comprising an outlet tube, the outlet tube comprising a cylinder with a longitudinal axis, an exit at a first end, and, a valve, the valve opened by pushing on a push button in a direction parallel to the longitudinal axis and in a direction towards the first end, the button located at a second end of the cylinder, the connector comprising:

i. a hollow cylindrical connector body, having a first end and a second end, ii. the connector body first end sized to fit over the first end of the spigot, and, iii. the connector body second end having an exit port that includes a barb for connection to flexible tubing, and, iv. a clip extending vertically from a rim of the connector body first end, the clip terminating with a right angle bend that when fit over the button simultaneously: secures the connector to the spigot, and, depresses the button thereby opening the valve on the spigot.

3. A fluid dispenser comprising:

a. a housing, b. a plurality of connectors, each of the connectors to connect to one of a plurality of fluid containers, and, each of the plurality of connectors having a connector exit port such that when each of the plurality of connectors is connected to one of the plurality of containers fluid from with the fluid container flows out through the connector exit port, and, c. a valve manifold, located within the housing, the valve manifold comprising:

i. a plurality of inlet ports, each of the plurality of inlet ports connected via the flexible tubing to an exit port of one of the plurality of connectors, ii. a multiport valve that includes an actuator having a plurality of positions that connects sequentially each of the plurality of inlet ports to an exit port based upon the position of the actuator and thereby dispenses sequentially fluid from one of the plurality of fluid containers through the exit port, and, d. the housing further including a cavity and a hook extending from the cavity such that the hook attaches the housing to a storage object and at least a portion of the storage object fits within the cavity.

4. The fluid dispenser of claim 3 wherein each of the plurality of fluid containers including a spigot that includes an outlet tube, the outlet tube comprising a cylinder with a longitudinal axis, and a valve, the valve opened by pushing on a push button in a direction parallel to the longitudinal axis and in the direction of the outlet tube, and, each of the plurality of connectors comprising:

i. a hollow cylindrical body, having a first end and a second end, ii. the first end sized to fit over the outlet tube of the spigot of the fluid container, and, iii. the second end having an exit port that includes a barb for connection to flexible tubing, and, iv. a clip extending vertically from a rim of the first end, the clip terminating with a right angle bend that simultaneously: secures the tab to the spigot, and, depresses the push button thereby opening the valve on the spigot.

5. The dispenser of claim 3 wherein the storage object is one of the plurality of fluid containers.

6. The dispenser of claim 4 wherein the storage object is one of the plurality of fluid containers.

* * * * *